US010543612B2

(12) United States Patent
Bagley

(10) Patent No.: US 10,543,612 B2
(45) Date of Patent: Jan. 28, 2020

(54) SPIRAL SLICER

(71) Applicant: Progressive International Corporation, Kent, WA (US)

(72) Inventor: Justin Bagley, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 443 days.

(21) Appl. No.: 15/267,725

(22) Filed: Sep. 16, 2016

(65) Prior Publication Data

US 2017/0080588 A1 Mar. 23, 2017

Related U.S. Application Data

(60) Provisional application No. 62/222,343, filed on Sep. 23, 2015.

(51) Int. Cl.
*B26D 3/11* (2006.01)
*B26D 3/28* (2006.01)

(52) U.S. Cl.
CPC ..... *B26D 3/11* (2013.01); *B26D 3/283* (2013.01); *B26D 2003/288* (2013.01); *B26D 2210/02* (2013.01)

(58) Field of Classification Search
CPC .. A23N 1/003; A23N 4/18; A47J 19/02; A47J 19/06; A47J 43/255; B26D 3/26; B26D 3/283; B26D 2003/288; B26D 2210/02; B26D 7/0608
USPC ..... 99/510, 512, 513, 538
See application file for complete search history.

(56) References Cited

U.S. PATENT DOCUMENTS

2004/0231482 A1* 11/2004 Boilen ..... B26D 3/283 83/425.3
2010/0252665 A1* 10/2010 Reimann ..... A47J 43/255 241/83

FOREIGN PATENT DOCUMENTS

DE 202015000837 U1 * 5/2015 ..... A47J 43/288

OTHER PUBLICATIONS

English translation of DE 202015000837 U1.*

* cited by examiner

*Primary Examiner* — Ibrahime A Abraham
*Assistant Examiner* — Chris Q Liu
(74) *Attorney, Agent, or Firm* — Lowe Graham Jones PLLC

(57) ABSTRACT

A cone-type spiral slicer includes a blade along the sidewall for cutting a vegetable into thin strips. The housing is formed in a first portion and a second portion that are separable from one another. A retractable set of julienne blades allows the user to selectively use the slicer for cutting either wide strips or narrow julienne strips.

16 Claims, 9 Drawing Sheets

SPIRAL SLICER

PRIORITY CLAIM

This application claims the benefit of U.S. provisional application No. 62/222,343, filed Sep. 23, 2015, the contents of which are incorporated by reference.

FIELD OF THE INVENTION

This application relates to devices for cutting vegetables in a spiral shape.

BACKGROUND OF THE INVENTION

A cone-type spiral slicer can include a blade along the sidewall for cutting a vegetable into thin strips. One of the defects of such devices is that they do not include the ability to selectively allow either wide strips or thin julienne strips to be cut in the same device and using the same blade. In addition, the devices are formed with a fixed cone and mounted blade, making it difficult to clean bits of food from the device, particularly in the narrow, pointed end of the cone forming the device.

SUMMARY OF THE INVENTION

The present invention comprises a housing, preferably formed as a cone, having an open base and, in some versions, an open vertex or pointed end. An elongated blade is positioned along a sidewall, extending between the vertex and the base, with an opening adjacent the blade to allow a sliced food item to pass through the opening after it is cut by the blade.

In accordance with a preferred version, a selectable set of julienne blades is provided along another section of the conical sidewall and preferably extending along a sidewall length that is about equal to the length of the main slicing blade.

In one version, the set of julienne blades can be optionally moved between an extended position and a retracted position, allowing a user to selectively either use the julienne blades for cutting or stow the.

A preferred spiral slicer is formed to allow the conical housing to move or pivot between a closed position for use and an open position for cleaning. In one example, a clasp is pivotally mounted to provide a means for locking and unlocking the pivotal connection to open and close the cone.

In one example, the julienne blades are mounted on a blade post adjacent the clasp, with a knob accessible through an opening formed in the clasp so that the julienne blades can be selectively extended or stowed by operating the knob through the opening.

In one version, the clasp extends outward from the outer sidewall to provide a handle for grasping the spiral slicer. Optionally, the cone portions are pivotally connected to one another via a hinge formed with one or more raised knuckles, in which the raised knuckles extend outwardly from the cone. In this version, the combined clasp and raised knuckles provide convenient surfaces for a user to grasp the device in a controllable way.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
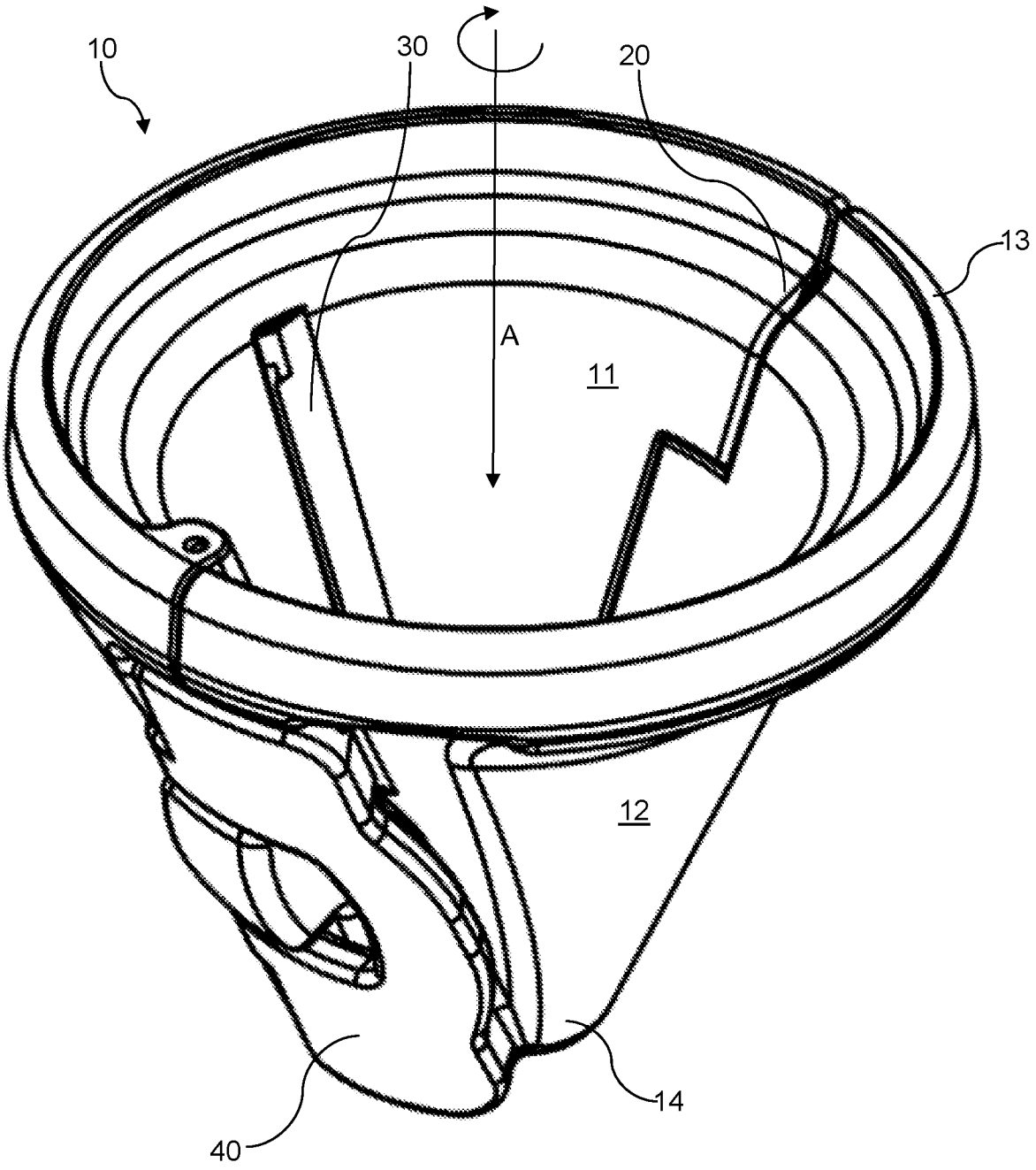
FIG. 1 is a top perspective view of a preferred spiral slicer.

As shown in FIG. 1, a preferred spiral slicer 10 includes a housing formed in a conical shape having a base 13 and a vertex 14. In the illustrated example the cone is shown as essentially inverted, with the vertex at the bottom and the base at the top. As a device intended to be hand-held, the orientation may vary according to the manner a user prefers to hold the device when in use. The base and vertex preferably are each open, and in the illustrated example the base is formed as a large open rim of the spiral slicer, allowing it to receive relatively large vegetables or other items for slicing. The vertex, by contrast is relatively narrow and terminates in a small opening in the illustrated version.

In the illustrated example, the slicer housing 10 is formed in two portions or halves 11, 12 (though the portions need not be evenly sized) that are pivotally connected along a pivot location 20 and which bifurcate the housing into substantially equal portions. The pivot location or hinge extends along a portion of the inclined sidewall of the cone. Each of the two portions includes a vertex end and a base end, so that each portion mates with the other portion along interfaces extending from the base to the vertex. Accordingly, and as discussed further below, the cone can pivot between an open and a closed position, primarily to facilitate cleaning of the slicer. The first and second portions pivot along the hinge, and have opposite sides that mate along an interface between the vertex end and the base end. A clasp 40 is attached to a first one of the cone halves 11 and is configured to selectively connect or disconnect to the opposite half, or second one of the cone halves 12, to enclose or open the cone, as desired.

In general, the slicer is operable by a user to slice a food item (such as a carrot, for example) by inserting the food item into the cone in the direction of the arrow indicated by axis A, which extends through the center of the cone forming the slicer 10. As the food item is axially inserted, it is also rotated about the central axis A in the direction of the rotational arrow shown about the axis A in FIG. 1. This axial insertion and combined rotation will cause the food item to encounter the blade 30, slicing the food item in a circular fashion as it is inserted and rotated. As shown, the blade 30 is positioned at a location along the interior sidewall of the cone, and in this case mounted on the first cone half 11.

Figure 2:
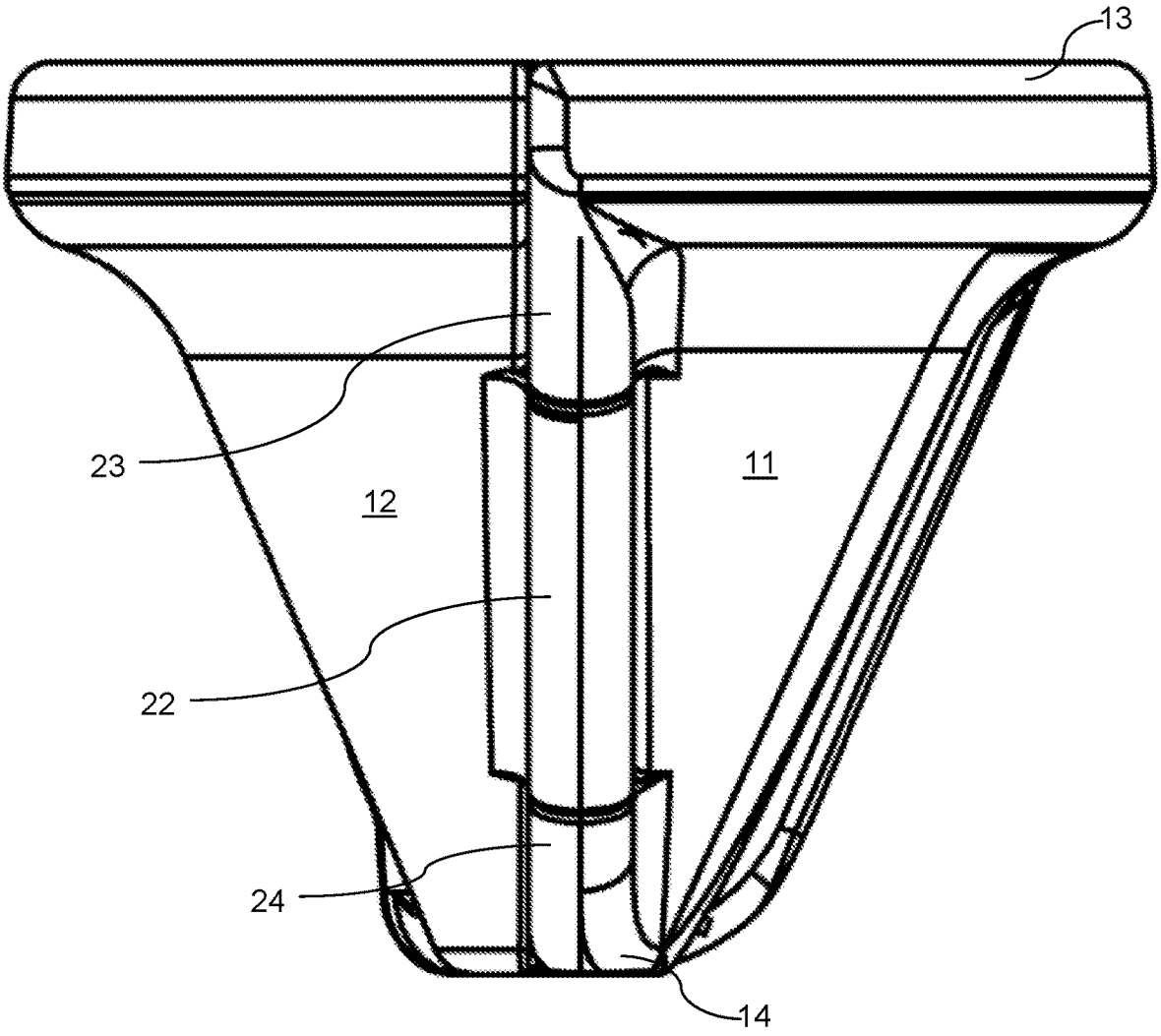
FIG. 2 is a rear elevational view of a spiral slicer.

With reference to FIG. 2, the halves 11, 12 of the cone are hingedly attached along a hinge barrel extending outward from the cone. The barrel is formed by an upper knuckle 23 and lower knuckle 24 positioned on the first cone half 11, and a central knuckle 22 positioned on the second cone half 12. The knuckles may be joined together by a separate pin extending through the knuckles, or by one or more integrally formed pins (e.g., 81, see FIG. 8) mating with complementary recesses formed in adjacent knuckles. It should further be appreciated that the cone halves 11, 12 need not be formed as evenly divided halves, but rather one section or the other of the cone portions 11, 12 may be larger than the other. As discussed below, the outwardly-extending hinge knuckles provide a useful handle for grasping the slicer when in use.

Figure 3:
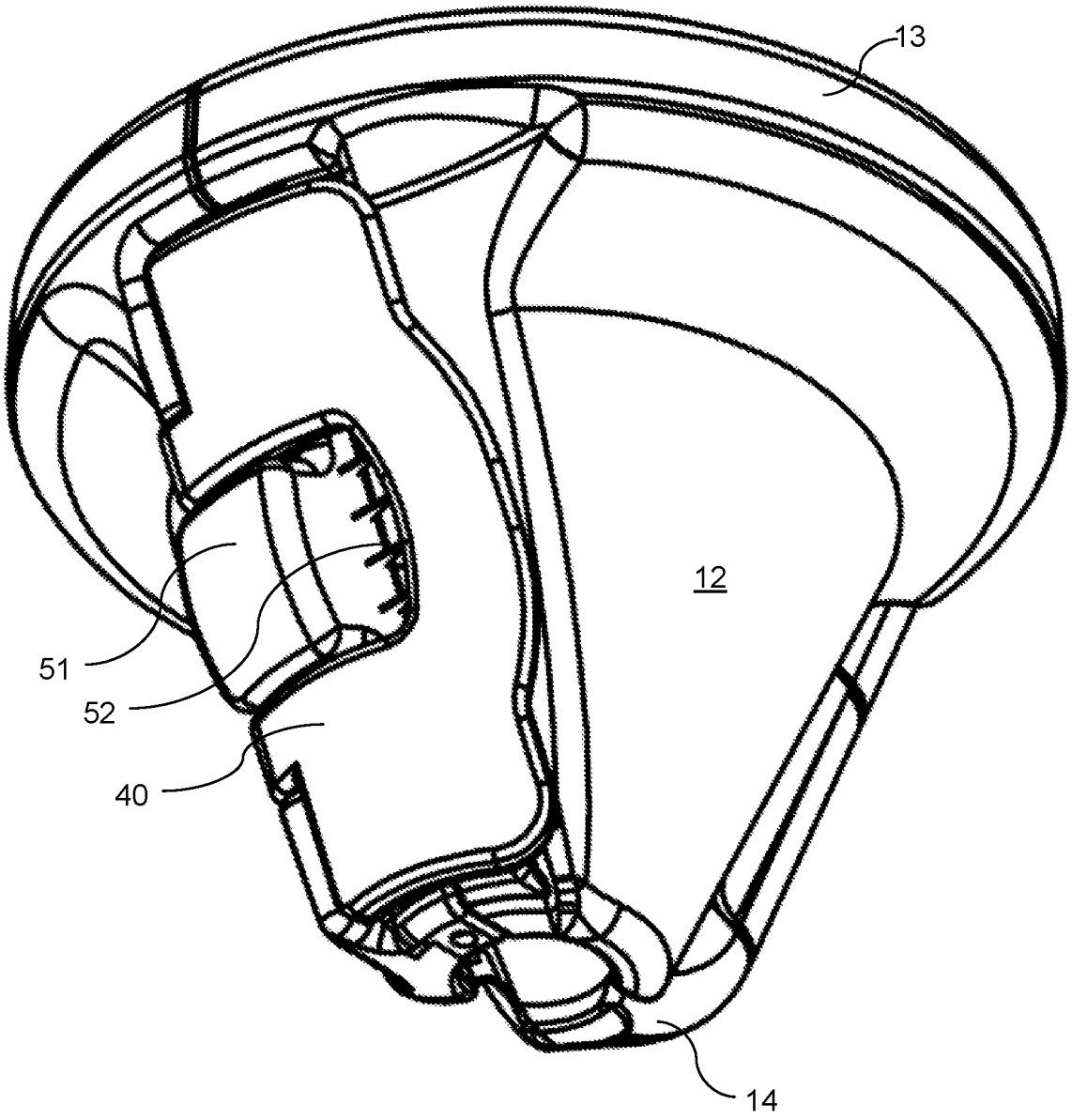
FIG. 3 is a bottom perspective view of a spiral slicer.

The seam of the cone opposite the hinge is configured to open and close, and therefore includes a clasp 40 configured to enable the user to open and close the cone as desired. As further discussed below, the configuration of FIG. 3 is positioned with julienne blades 52 in a retracted position, in which they are moveable between extended and retracted positions by a knob 51. As also visible in FIG. 3, the julienne blades 52 are positioned adjacent the clasp, where the two cone halves open and close.

Figure 4:
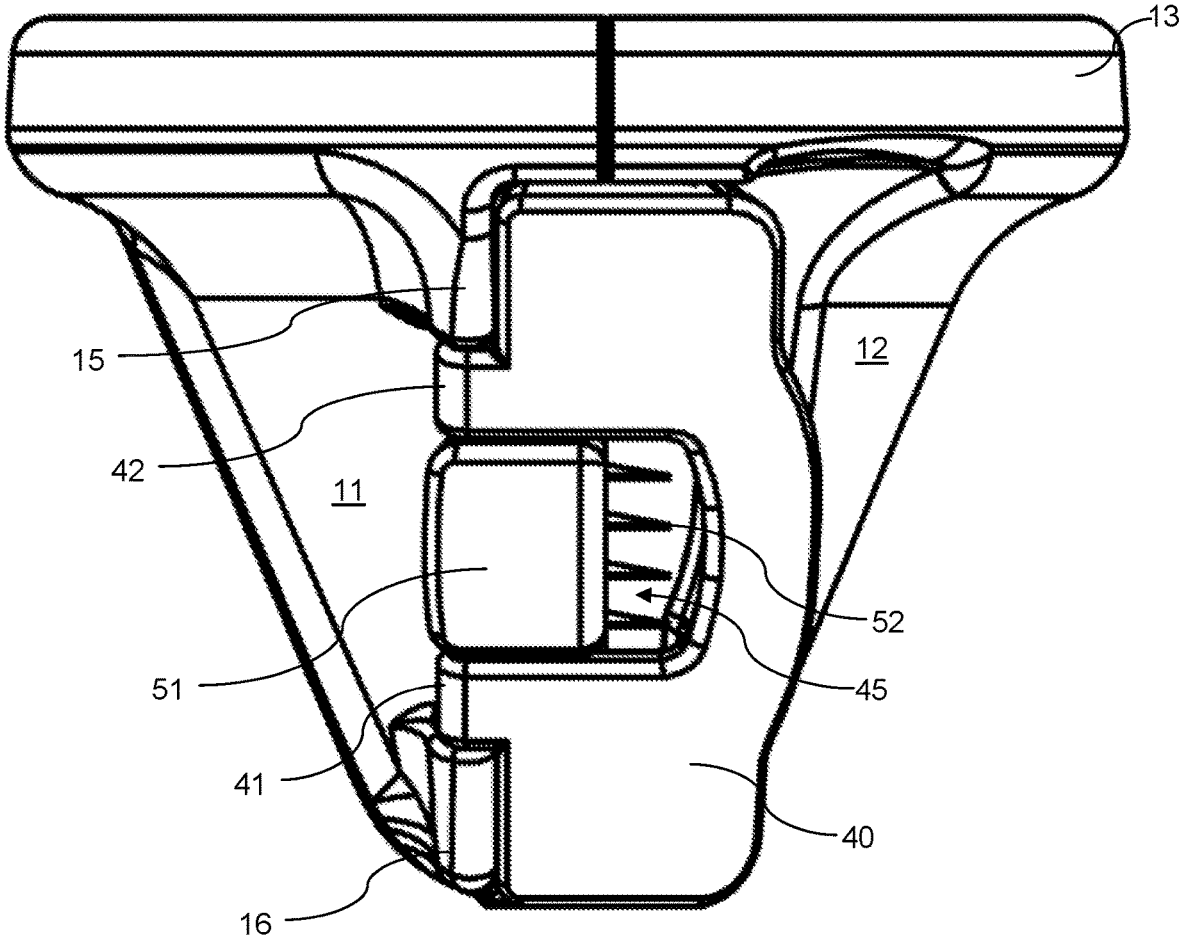
FIG. 4 is a front elevational view of a spiral slicer.
Figure 8:
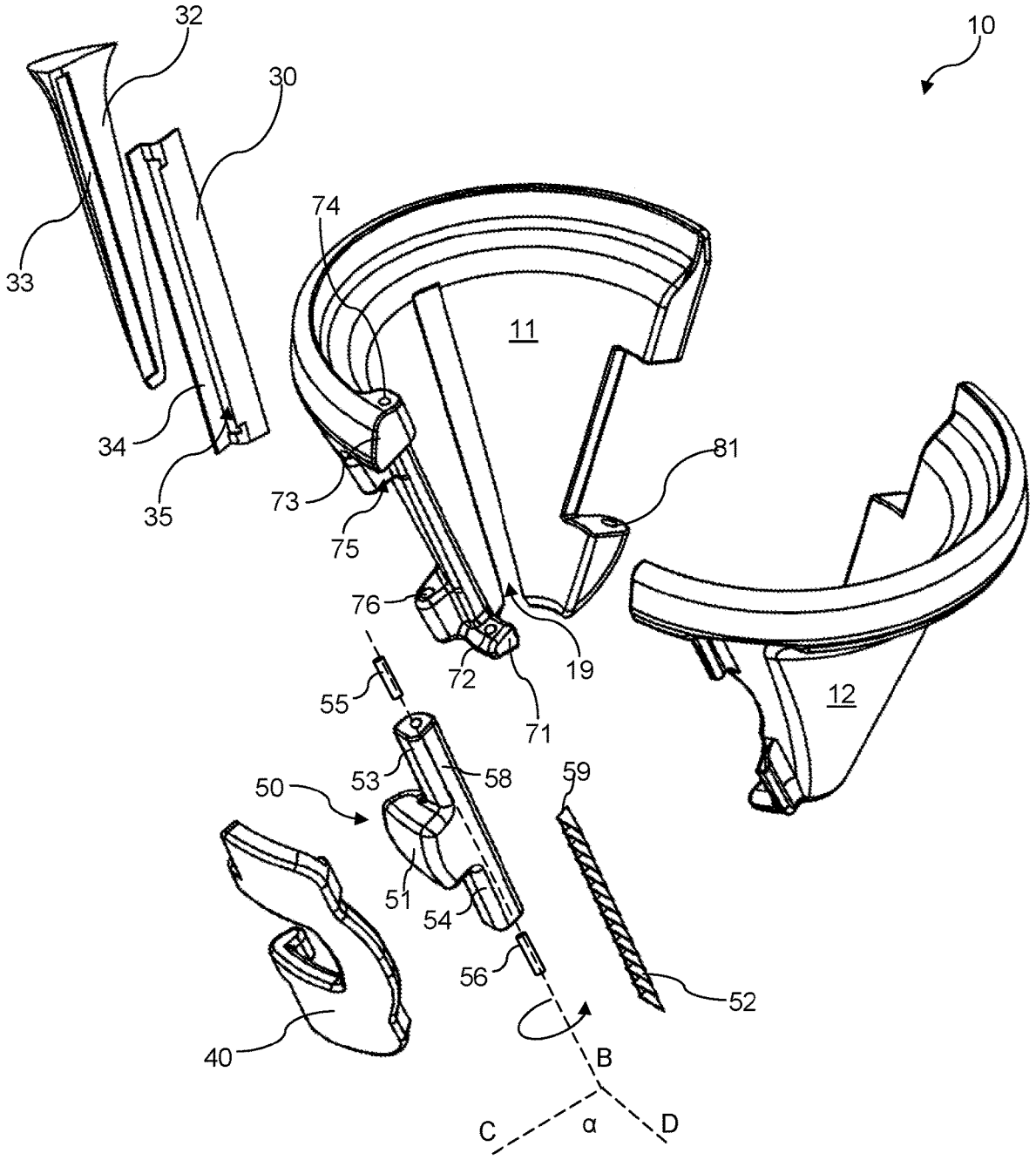
FIG. 8 is an exploded view of a spiral slicer.

The clasp 40 is hingedly attached to the first section 11 of the slicer cone, as seen in FIG. 4. In the illustrated example, the clasp includes an upper terminal 42 and lower terminal 41 configured to attach to upper and lower clasp knuckles 15, 16 formed on the first cone section 11. As with the cone sections, the clasp preferably attaches to the first cone section by mating pegs and recesses integrally formed in the knuckles and the upper and lower terminals. For example, as best seen in FIG. 8, the upper and lower clasp knuckles may include recesses 75, 76 for receiving mating pegs formed in the upper and lower terminals 41, 42. The clasp and cone half may be otherwise attached to one another to allow for the clasp to pivot about an axis on the cone half.

In the position of FIG. 4, the clasp 40 includes an opening 45 configured as a cutout between the upper and lower terminals 41, 42. A plurality of julienne blades 52 is partially visible through the opening, in which the blades are oriented essentially parallel to the conical sidewall and therefore in a retracted position. Thus, in the retracted position, the julienne blades do not extend into the interior space of the cone. In an extended position, the julienne blades would be directed inward, toward the central axis of the cone and into the interior space defined by the cone. Accordingly, in the position as illustrated in FIG. 4, the slicer is configured to cut spiral slices using the slicing blade 30, but is not configured to also cut the food item into small strips with the julienne blades 52. As further discussed below, the julienne blades 52 are configurable between the retracted position and extended position by grasping and rotating the knob 51.

Figure 5:
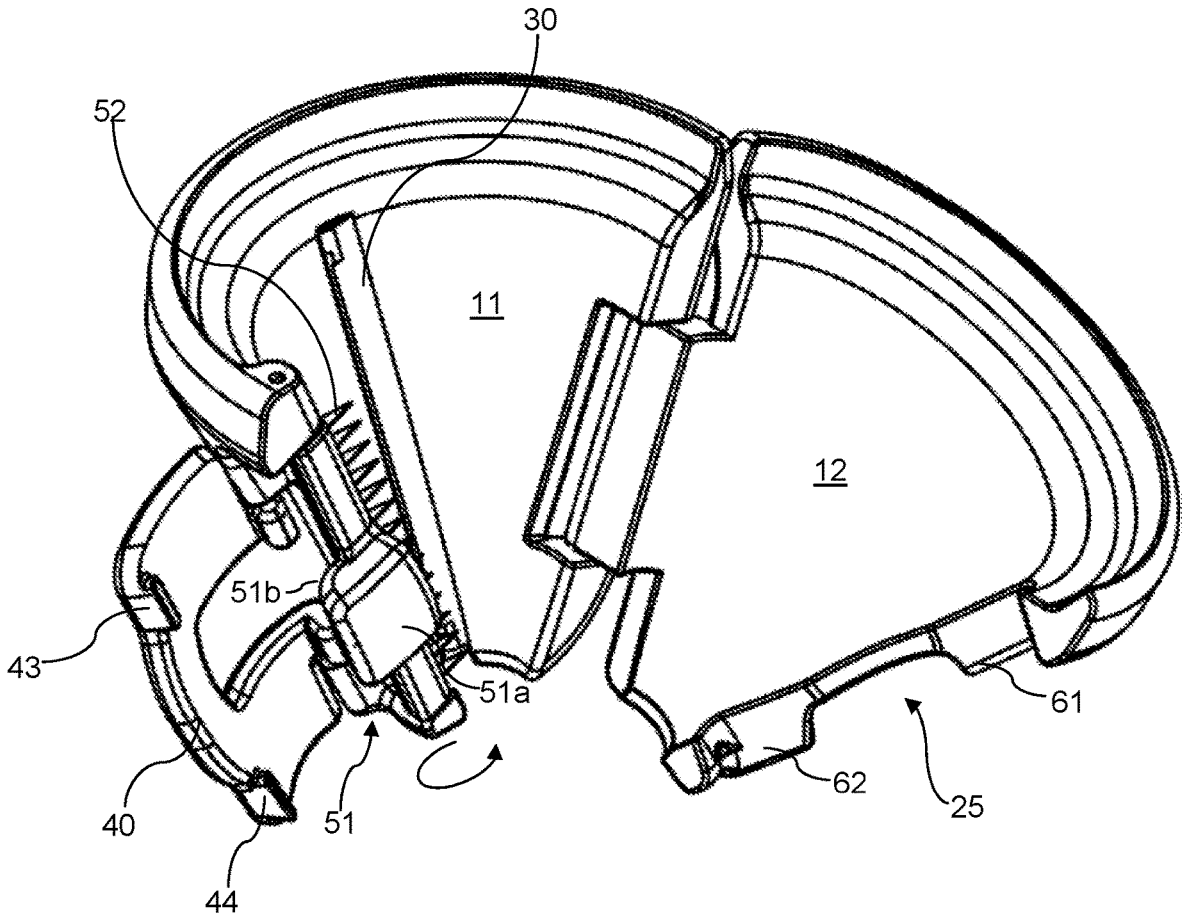
FIG. 5 is a top perspective view of a spiral slicer, shown in an open position in which two halves forming the slicer are hinged apart.
Figure 6:
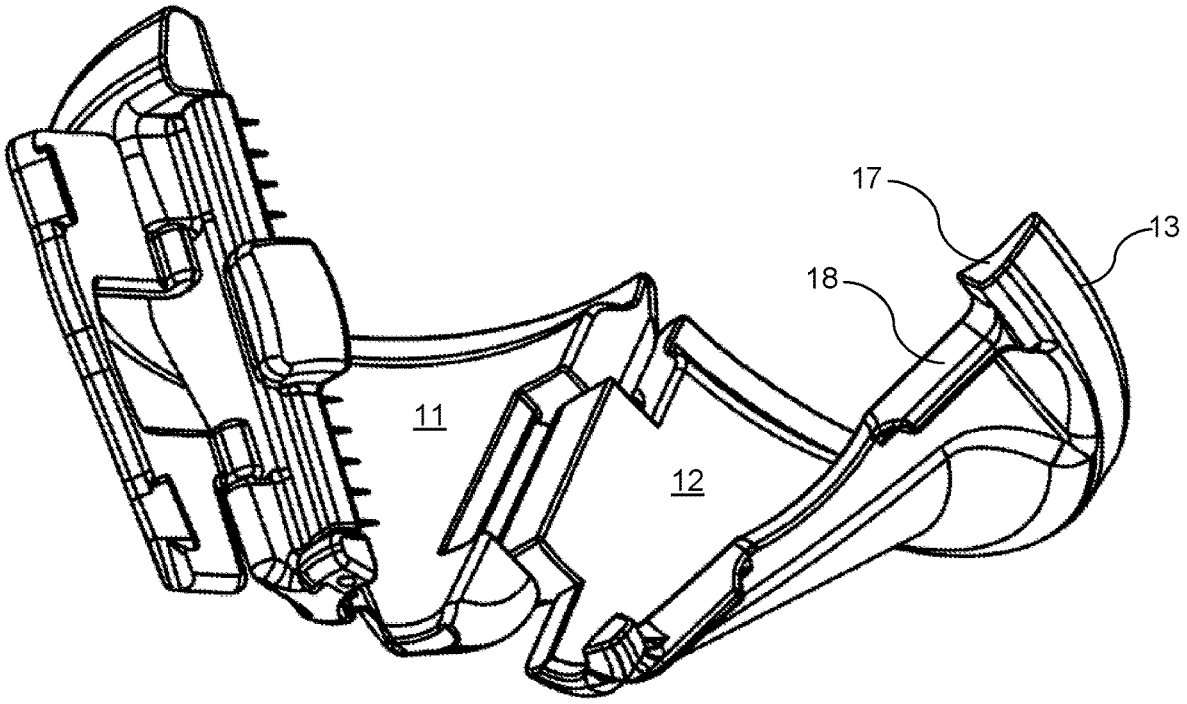
FIG. 6 is a bottom perspective view of a spiral slier, shown in the open position.
Figure 7:
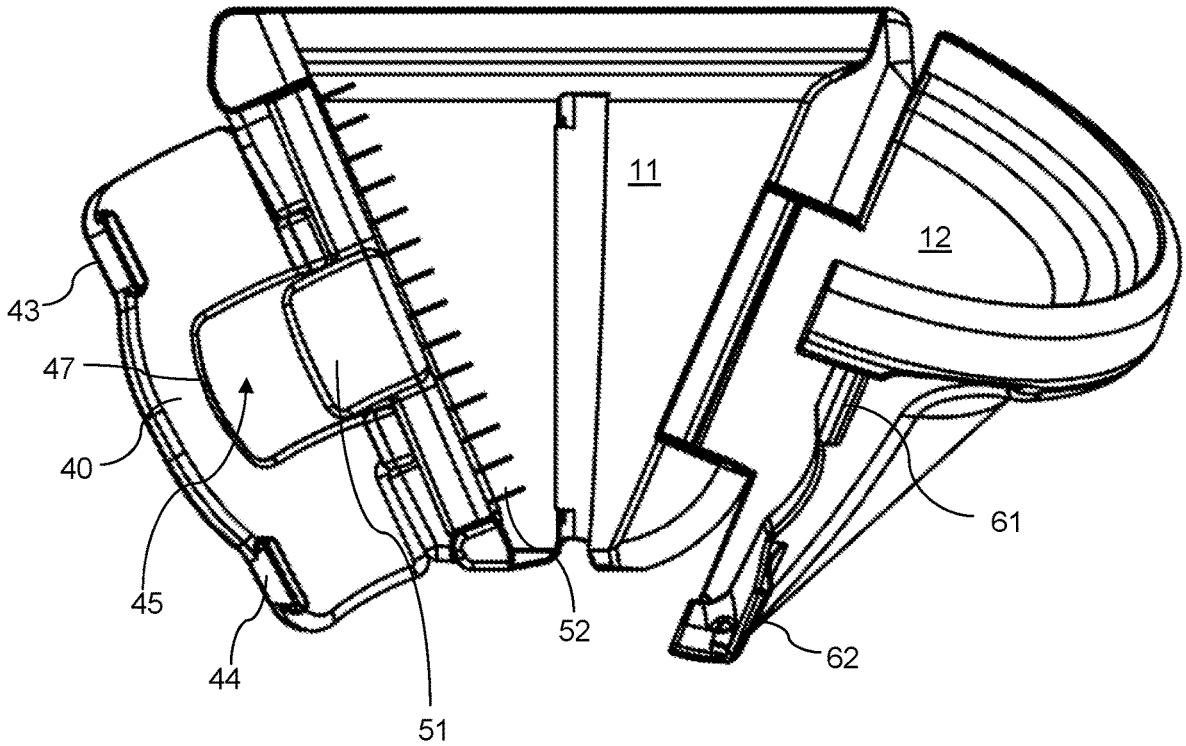
FIG. 7 is a front elevational view of a spiral slicer, shown in the open position.

FIG. 5 shows the slicer in an open position in which the two sections or halves 11, 12 have been pivoted to an open position along the hinge. FIGS. 6 and 7 likewise show the slicer in an open position, but from different perspectives. As seen in these figures, the clasp 40 includes a pair of clips 43, 44 formed on a terminal end of the clasp, opposite the clasp hinge, and configured to mate with complementary clip surfaces 61, 62 formed on the opposite cone section 12. Most preferably, the clips and complementary clip surfaces are formed with shapes in which a reasonable prying force is required in order to disengage them from one another in order to open the clasp and therefore hinge the cone into an open position. Likewise, the clasp is preferably configured to snap to a locked position when the clips and complementary clip surfaces engage one another in the closed position.

In the position of FIGS. 5-7, the knob 51 (and therefore the julienne blades 52) has been rotated in the direction of the arrow shown in FIG. 5. This counterclockwise rotation from the position in FIG. 4 is preferably a rotation of 90 degrees, causing the julienne blades to rotate from the retracted position to the extended position of FIG. 4 to the extended position of FIG. 5. Thus, as shown in FIG. 5, the julienne blades 52 are directed inward, toward the middle of the cone. Most preferably, the knob 51 includes a relatively flat side 51*a* which faces outward when the julienne blades are in the retracted position, and an adjacent rounded side 51*b* (at an orthogonal face, but continuing in a rounded fashion about the perimeter of the knob), which faces outward when the julienne blades are in the extended position.

As seen in FIG. 6, the second cone section 12 is preferably formed with a mating open edge that is recessed along a central portion 18 as compared to the edge 17 formed at the upper rim 13. The recessed area is configured to allow space for movement of the julienne blades into the retracted position and back into the extended position. A middle cutout 25 positioned at a central location along the open edge is formed in order to accommodate a portion of the knob 51 when the knob is rotated to the extended julienne blade position.

With reference to the exploded view of FIG. 8, the julienne blade cartridge 50 is best seen and includes a knob 51 attached to a blade post formed with an upper section 53 and a lower section 54. In the illustrated version, the knob and upper and lower blade posts are integrally formed. The blade post preferably includes a generally flat edge 58 which is configured to provide a surface for mounting the set of julienne blades 52. Thus, the julienne blades are most preferably formed in a triangular shape, in which a base 59 is attached to the blade post along the flat edge 58 of the blade post, and the sharpened angled surface extends outward from the post. In the illustrated example, the knob 51 preferably includes an outer surface (indicated by the reference number 51 in FIG. 8) that extends radially outward along a radial direction C from an axis B formed by the blade post and a pair of upper and lower pins 55, 56. The julienne blades also extend radially outward along a radial D form the same blade post axis, forming an angle $\alpha$ between radials C and D, which is preferably about 90 degrees. Accordingly, rotation of the knob and the blade post through the same angle $\alpha$ will move the julienne blades between the extended and retracted positions. As further illustrated in FIG. 8, the pins 55, 56 are received in mating recesses formed in the blade post and also in recesses 72, 74 formed on upper and lower supports 71, 73 formed on the first conical section 11. This manner of attachment allows the blade post to rotate as described above.

When the blade post rotates to a deployed or extended position, the outer surface 51*a* of the knob 51 will abut the inner edge 47 (see FIG. 7) of the opening 45 formed in the clasp, thereby preventing over-rotation of the set of blades. Similarly, in the retracted position, a portion of the adjacent surface 51*b* on the knob 51 abuts a surface on the first conical section 11 to prevent rotation of the blades into an orientation where they would extend outward from the cone. Accordingly, the blade post and the blades are restricted to a rotational path of travel of 90 degrees in the preferred version.

Figure 9:
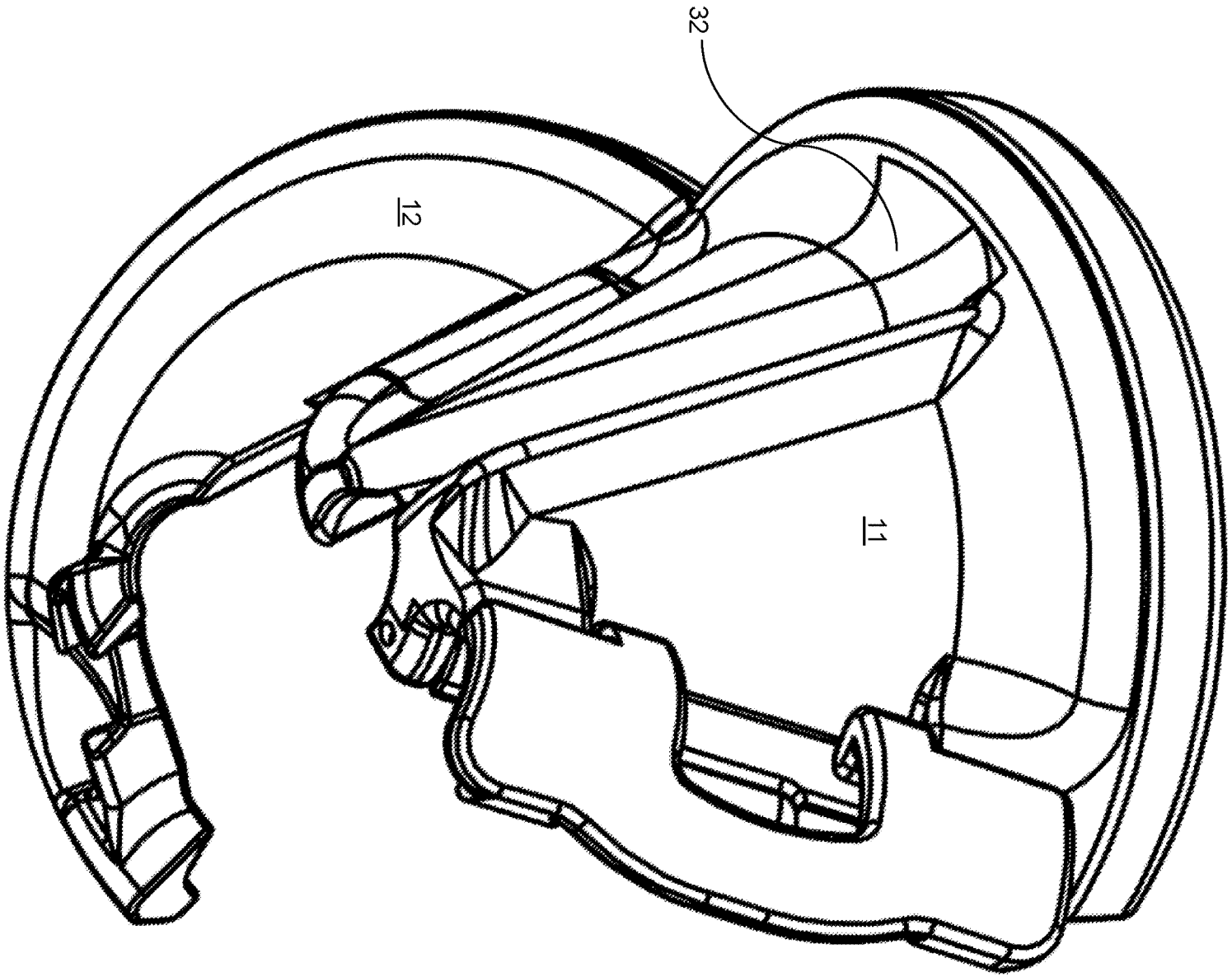
FIG. 9 is a side elevational view of a spiral slicer, shown in the open position.

As also best seen in FIG. 8, the main slicing blade 30 is formed with a sharpened edge and a gap 35 between the blade 30 and an adjacent mounting plate 34 to allow food to pass through the gap when it is sliced. Most preferably the blade and mounting plate are integrally formed from stainless steel and bent along the gap as illustrated in order to provide a strong surface for attachment. The mounting plate of the blade is mounted to a support 32 having a recessed seat 33 configured to receive the mounting plate. As seen in FIG. 9, the blade support is then attached to an outer surface of the first cone section 11 to mount the blade to the cone section. The blade and blade mount are positioned over an elongated opening 19 (see FIG. 8) formed in the first cone section 11.

In use, a user first selects whether to move the set of julienne blades to an extended or retracted position by operating the knob 51 in order to rotate the blade post and julienne blades, as discussed above. A food item such as a carrot is inserted into the open base of the cone until it encounters the blades, and is then rotated as it is inserted into the cone. The rotation of the food item (in the direction of the circular arrow in FIG. 1) with respect to the slicing cone causes the food item to encounter the julienne blades (if extended) and the main slicing blade 30. Slices of carrot or other food item pass through the opening 35 adjacent the main slicing blade, and are also cut into narrow strips if the julienne blades are extended. The outward position of the hinge barrel and the clasp provide useful grips allowing the user to hold the device when slicing.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A spiral slicer, comprising:

a first housing portion pivotally attached to a second housing portion, the first housing portion and the second housing portion defining a conical housing having sidewalls inclining from an open vertex end to a base end having an open rim, the conical housing further defining an interior space between the vertex end and the base end;

the conical housing further being selectively movable between a closed position in which the first housing portion and the second housing portion cooperate to form the conical housing, and an open position in which the first housing portion is pivoted apart from the second housing portion;

a main slicing blade mounted on the first housing portion, the first housing portion further having a blade opening extending along the main slicing blade, whereby a food item sliced by the main slicing blade will pass through the blade opening;

a lock attached to the conical housing, the lock being positioned to hold the first housing portion and the second housing portion in the closed position; and a set of julienne blades mounted on the conical housing and selectively movable between an extended position in which the set of julienne blades extend into the interior space, and a stowed position in which the set of julienne blades are retracted out of the interior space.

2. The spiral slicer of claim 1, wherein the first housing portion and the second housing portion mate along an interface of the conical housing in the closed position, and further wherein the lock is configured as a clasp extending across the interface.

3. The spiral slicer of claim 2, wherein the set of julienne blades are carried on a cartridge pivotally mounted at the interface.

4. The spiral slicer of claim 3, wherein the cartridge further comprises a knob for selectively moving the cartridge and the set of julienne blades between the extended position and the stowed position.

5. The spiral slicer of claim 4, wherein the clasp further comprises a cutout, the knob being accessible through the cutout when the conical housing is in the closed position.

6. The spiral slicer of claim 4, wherein the first housing portion is pivotally attached to the second housing portion along a hinge, the hinge having one or more knuckles projecting radially outward from the conical housing.

7. The spiral slicer of claim 6, wherein the second housing portion further comprises a recessed region positioned at the interface when the first housing portion and the second housing portion are in the closed position, the recessed region being sized and positioned to receive a portion of the knob when the set of julienne blades are in the extended position.

8. A spiral slicer, comprising:

a housing having a vertex end and a base end with sidewalls inclining upwardly from the vertex end to the base end, the base end terminating in an open rim, the housing defining an interior space within the sidewalls;

the housing sidewalls being formed by a first housing portion and a second housing portion, the first housing portion and the second housing portion being selectively movable between a closed position in which the first housing portion and the second housing portion cooperate to define the interior space, and an open position in which the first housing portion is moved apart from the second housing portion;

a main slicing blade mounted on the first housing portion, the first housing portion further having a blade opening extending along the main slicing blade, whereby a food item sliced by the main slicing blade will pass through the blade opening;

a lock for holding the first housing portion and the second housing portion in the closed position; and a set of julienne blades mounted on the housing and selectively movable between an extended position in which the set of julienne blades extend into the interior space, and a stowed position in which the set of julienne blades are retracted out of the interior space.

9. The spiral slicer of claim 8, wherein the first housing portion and the second housing portion bifurcate the housing.

10. The spiral slicer of claim 8, wherein the first housing portion and the second housing portion are pivotally attached.

11. The spiral slicer of claim 10, wherein the set of julienne blades are carried on a cartridge pivotally mounted on the housing sidewalls.

12. The spiral slicer of claim 11, wherein the cartridge further comprises a knob for selectively moving the cartridge and the set of julienne blades between the extended position and the stowed position.

13. The spiral slicer of claim 12, wherein the lock further comprises a clasp having a cutout, the knob being accessible through the cutout when the housing is in the closed position.

14. The spiral slicer of claim 13, wherein the second housing portion further comprises a recess sized and positioned to receive a portion of the knob when the set of julienne blades are in the extended position.

15. The spiral slicer of claim 12, wherein the first housing portion is pivotally attached to the second housing portion along a hinge, the hinge having one or more knuckles projecting radially outward from the conical housing.

16. The spiral slicer of claim 8, wherein the main slicing blade extends from the vertex end to the base end of the housing.

* * * * *